US009221169B2

(12) United States Patent
Seidel

(10) Patent No.: US 9,221,169 B2
(45) Date of Patent: Dec. 29, 2015

(54) TOOL BOX, ESPECIALLY HAND TOOL BOX

(75) Inventor: Thorsten Seidel, Remseck (DE)

(73) Assignee: ROBERT BOSCH GMBH, Stuttgart (DE)

( * ) Notice: Subject to any disclaimer, the term of this patent is extended or adjusted under 35 U.S.C. 154(b) by 13 days.

(21) Appl. No.: 13/382,471

(22) PCT Filed: Jun. 2, 2010

(86) PCT No.: PCT/EP2010/057684
§ 371 (c)(1),
(2), (4) Date: Mar. 26, 2012

(87) PCT Pub. No.: WO2011/003678
PCT Pub. Date: Jan. 13, 2011

(65) Prior Publication Data

US 2012/0206907 A1 Aug. 16, 2012

(30) Foreign Application Priority Data

Jul. 9, 2009 (DE) ..... 10 2009 027 573

(51) Int. Cl.
*B25H 3/02* (2006.01)
*B25H 3/00* (2006.01)

(52) U.S. Cl.
CPC . *B25H 3/006* (2013.01); *B25H 3/02* (2013.01)

(58) Field of Classification Search
CPC ..... F21V 33/0084; B25H 3/02
USPC ..... 362/156
See application file for complete search history.

(56) References Cited

U.S. PATENT DOCUMENTS

| | | | | |
|---|---|---|---|---|
| 3,938,132 | A | 2/1976 | Cunningham | |
| 4,927,021 | A | 5/1990 | Taylor | |
| 5,219,446 | A | 6/1993 | Klepac | |
| 5,459,648 | A * | 10/1995 | Courtney | 362/154 |
| 5,533,843 | A | 7/1996 | Chung | |
| 5,624,029 | A * | 4/1997 | Shih | 206/372 |
| 5,685,421 | A | 11/1997 | Gilmore | |
| 5,803,586 | A * | 9/1998 | Velez et al. | 362/154 |
| 6,254,251 | B1 | 7/2001 | Washington | |
| 6,981,780 | B2 | 1/2006 | Einav | |
| 7,222,620 | B2 * | 5/2007 | Wolter et al. | 126/39 BA |
| 7,252,404 | B1 | 8/2007 | Messamore | |
| 7,290,655 | B1 | 11/2007 | Wood | |
| 7,389,608 | B1 * | 6/2008 | MacKay | 43/57 |
| 2004/0134818 | A1 | 7/2004 | Cunningham et al. | |
| 2004/0228114 | A1 * | 11/2004 | Chen | 362/84 |
| 2005/0156564 | A1 * | 7/2005 | Krieger | 320/112 |
| 2008/0035507 | A1 | 2/2008 | Collister et al. | |

FOREIGN PATENT DOCUMENTS

| | | |
|---|---|---|
| CN | 2842201 | 11/2006 |
| EP | 1 273 397 | 1/2003 |
| JP | 2006 205325 | 8/2008 |

OTHER PUBLICATIONS

International Search Report, PCT International Application No. PCT/EP2010/057684, dated Sep. 1, 2010.

* cited by examiner

*Primary Examiner* — Thomas A Hollweg
*Assistant Examiner* — Christopher Raabe
(74) *Attorney, Agent, or Firm* — Kenyon & Kenyon LLP

(57) ABSTRACT

A tool box, especially a hand tool box, includes a basic box element, that has at least one storage space, which is provided at least for accommodating at least one tool and/or at least one accumulator unit. It is provided that the tool box have at least one light source unit that is at least partially integrated into the basic box element.

20 Claims, 3 Drawing Sheets

TOOL BOX, ESPECIALLY HAND TOOL BOX

FIELD OF THE INVENTION

The present invention relates to a tool box, e.g., a hand tool box.

BACKGROUND INFORMATION

Conventional hand tool boxes for keeping and transporting hand tools include a basic box element having storage space, that is provided for accommodating hand tools.

SUMMARY

Example embodiments of the present invention provide a tool box, especially a hand tool box, having a basic box element that has at least one storage space which is provided at least for accommodating at least one tool and/or at least one accumulator unit.

It is provided that the tool box have at least one light source unit that is at least partially integrated into the basic box element. By "basic box element" one should understand, in this context, particularly one or more shell-shaped elements, which border the storage space, and/or a lid, which borders the storage space and is provided for closing a shell-shaped element. The basic box element is preferably arranged as a unit that is portable by a person and preferably has a net weight of less than 50 kg, and especially preferably under 20 kg. By "light source unit" one should particularly understand a unit which has at least one light source, at least one holding unit, which is provided especially to hold at least one of the light sources, and has at least one energy supply unit, which is provided for the energy supply of a light source. By "provided" one should understand, in this context, specially designed, equipped and/or specially programmed. Furthermore, "integrated" should particularly be understood in that at least one part of the light source unit, at least in an operating state, is arranged to be safe from being lost and/or firmly connected to the basic box element, at least partially embedded in the basic box element, such as being particularly molded into it, and/or is at least partially arranged as one piece with the basic box element.

The functionality of the tool box may advantageously be improved. If the light source unit includes a light source designed as an outer illumination, an illumination of the work using a tool transported in the tool box is able to be ensured advantageously in dark work rooms. Furthermore, it can be ensured that a light source is always carried along during use, and one may avoid the costly transportation of an external light source. If the light source unit includes a light source designed as inside illumination, parts inside the tool box are able to be advantageously found in dark rooms.

The light source unit advantageously includes at least one energy supply unit, which is provided, that is, is specially equipped and/or designed, for supplying at least one light source of the light source unit. By "energy supply unit" one should understand, in this case, particularly a unit for current conduction, for current and/or voltage conversion, such as particularly from direct current to alternating current and vice versa, for storing electrical energy, for checking a charge state and/or for mounting one of the units named above. The energy supply unit is preferably integrated at least partially into the basic box element, in this instance, i.e. at least partially firmly connected to the basic box element, at least partially formed around by it, such as particularly molded around by it and/or at least partially arranged with the basic box element as one piece. The energy supply of a light source of the light source unit may be simply ensured constructively.

The flexibility of application is able to be raised advantageously if the energy supply unit includes at least one charging unit, an energy terminal location for the detachable connection to at least one energy terminal location of a light source of the light source unit and/or an energy connecting location for at least one cable that is provided for movably supporting a light source of the light source unit relative to the basic box element, and preferably a corresponding cable. The charging unit may preferably be provided for charging a hand tool accumulator unit and/or for charging an accumulator unit of a light source, in this instance.

It may be provided that the energy supply unit has at least one energy transmitting unit for energy transmission free of cables. "Energy transmitting unit for energy transmission free of cables" should be understood particularly to be a unit that is provided to transmit electrical energy without material current-carrying lines over at least a partial section. In this context, various methods are possible, but inductive methods are particularly advantageous. Using one corresponding energy transmitting unit, an energy transmission that is particularly flexible and insensitive to contamination by dirt is able to be achieved. The energy transmitting unit, in this instance, may be provided for transmitting energy between various parts of the light source unit, and/or may be provided for transmitting energy into the tool box.

If the energy supply unit has a connecting unit which connects an accumulator unit storage space of the basic box element, particularly a hand tool accumulator unit storage space, by energy technology to an additional part of the light source unit, particularly to a terminal location of the light source unit, accumulator units of a hand tool may advantageously be used for the energy supply of a light source of the light source unit. The connecting unit, in this instance, is preferably partially integrated in the basic box element, that is, particularly at least partially firmly connected to it, formed around by it and/or partially arranged as one piece with it.

If the light source unit has at least two light sources, different light sources may be provided flexibly for various applications, such as particularly for an outer illumination and an inner illumination.

If the light source unit has at least one light source having more than 10 W and preferably more than 20 W, an advantageous illumination may be achieved, especially in an outer region of the tool box.

It is further provided that the light source unit have at least one accommodating region on the outside of the basic box element which is provided for accommodating at least one light source. By the "outside" one should understand particularly the side of the basic box element facing away from the storage space. Using example embodiments, an advantageous decoupling between the storage space for the tool and an accommodating space for a light source may be achieved. Moreover, an advantageous outside illumination may be implemented, and, in particular, the basic box element may be utilized as a stand unit for a light source.

The accommodating region may at least have an extension and/or advantageously at least one recess, in which at least one light source is able to be countersunk at least partially and preferably at least for the most part. In this connection, "at least for the most part" should be understood to mean particularly that when the light source is situated in the recess, which amounts to more than 50% of the total volume of the light source, and thus particularly a part of the light source which projects beyond outer surfaces of the basic box element that are situated directly next to the recess, amounts to less than 50% of the total volume of the light source. By "recess", in this context, one should understand a free space which, in the region of the recess is limited by the basic box element and particularly by at least one imaginary plane that is formed by as much as possible a straight-line continuation of outer surfaces of the basic box element directly next to the recess. In example embodiments, an advantageous integration of the light source may be achieved, and in particular, one or more light sources may advantageously be positioned in a protected manner.

Further advantages are described in more detail in the description of the figures that follow. The drawings show an exemplary embodiment of the present invention. The drawings and the description include numerous features in combination. One skilled in the art will expediently consider the features also individually, and will combine them into further combinations. In the exemplary embodiment, a tool box having a plurality of light sources is shown in particular, which may also be provided only individually in a tool box or in other combinations as well, in a tool box.

DETAILED DESCRIPTION

Figure 1:
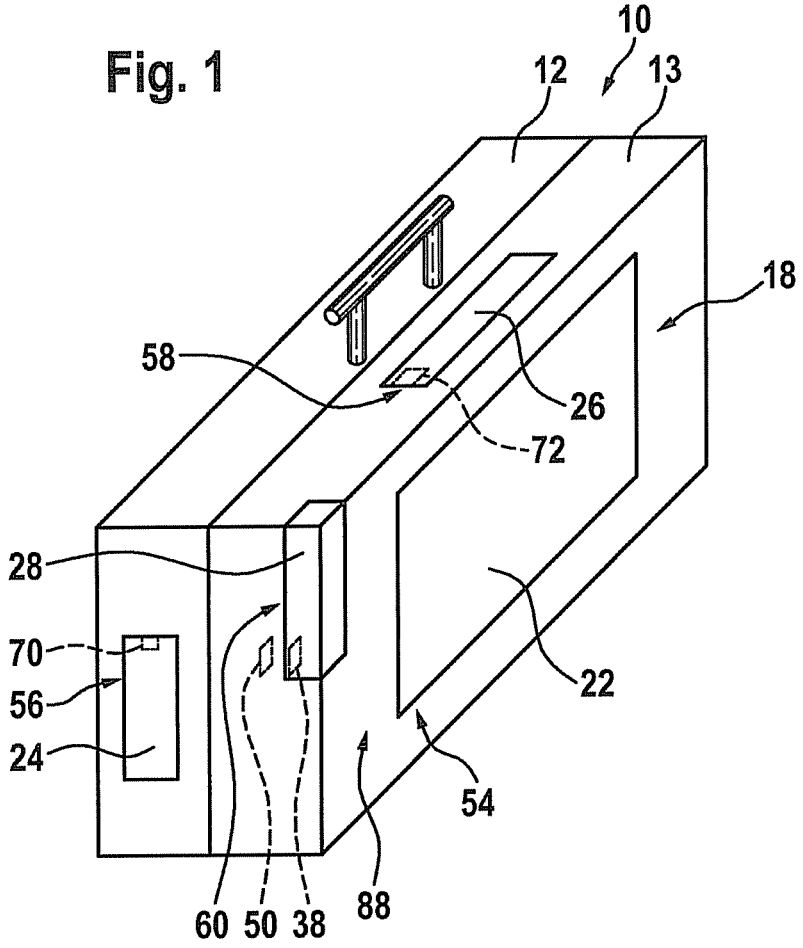
FIG. 1 is a schematic representation of a closed hand tool box diagonally from above.
Figure 2:
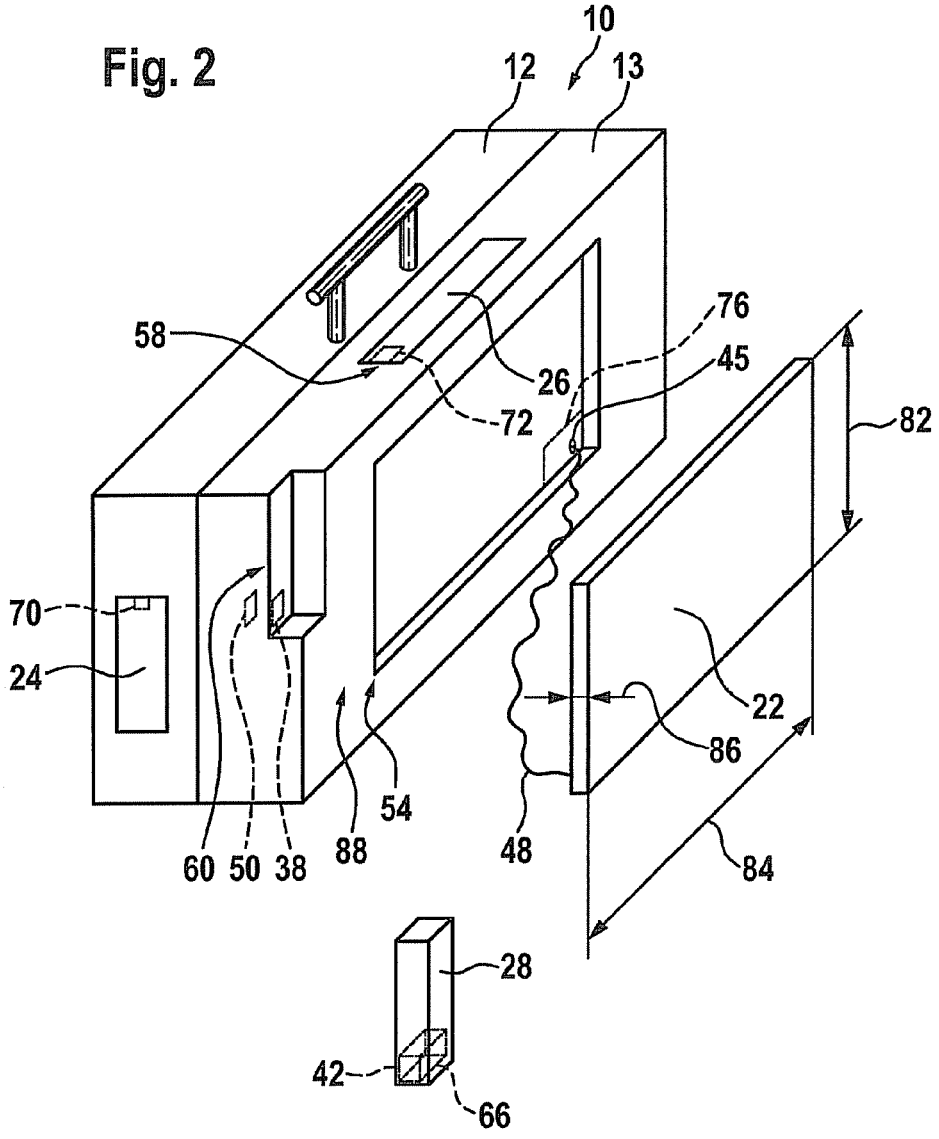
FIG. 2 illustrates the hand tool box as in FIG. 1, having partially disconnected light sources.

FIG. 1 shows a schematic representation of a closed hand tool box, namely an accumulator unit hand tool box for transporting a tool 16 developed as an accumulator unit hand tool. The hand tool box has a basic box element 10, which includes two shell-shaped elements 12, 13, and a storage space 14, bordered by the shell-shaped elements 12, 13, which is provided for the accommodation of the accumulator unit hand tool, of hand tool accumulator units 62 of the accumulator unit hand tool and of insertable tools 64 of the accumulator unit hand tool. The hand tool box has a light source unit 18 integrated into basic box element 10, having a plurality of light sources 22-34, which each have more than 10 W (FIGS. 1 through 4).

Figure 3:
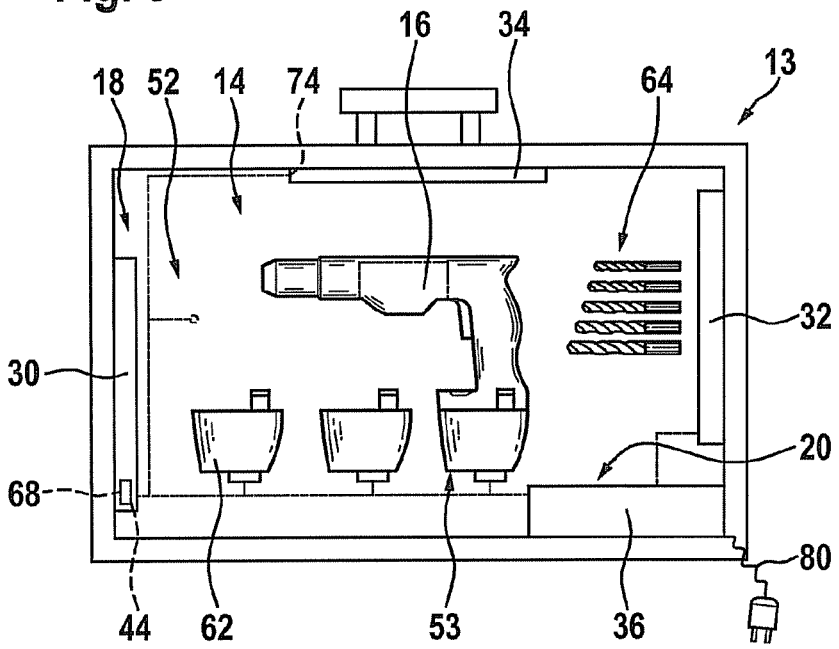
FIG. 3 is a schematic representation of the open hand tool box.
Figure 4:
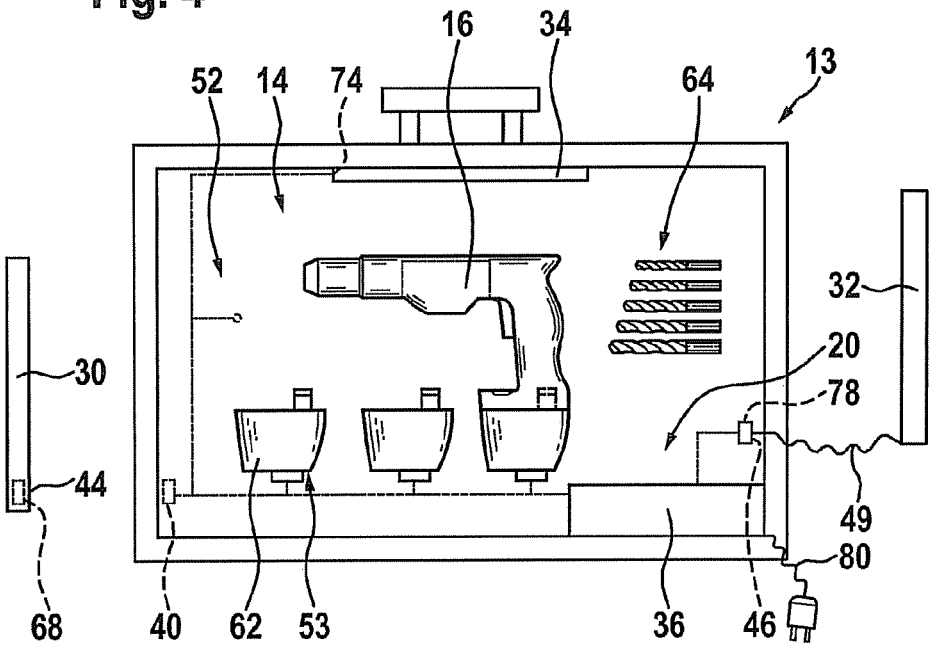
FIG. 4 illustrates the open hand tool box having partially disconnected light sources.

Light source unit 18 has an energy supply unit 20, integrated into basic box element 10, which is provided for supplying light sources 22-34 with energy. Energy supply unit 20 has a charging unit 36, which is provided for charging hand tool accumulator units 62 and light source accumulator units 66, 68 of light sources 28, 30. Energy supply unit 20 has a connecting unit 52, situated in a fixed manner in basic box element 10, which connects charging unit 36 to an accumulator unit storage space 53, that is provided for the accommodation of hand tool accumulator units 62, as well as charging unit 36 and accumulator unit storage space 53 of basic box element 10 to energy terminal locations 38, 40, 45, 46, 70, 72, 74 of basic box element 10 (FIGS. 3 and 4). Energy terminal locations 38, 40 are provided for the detachable connection to energy terminal locations 42, 44 of light sources 28, 30, which include light source accumulator units 66, 68, and which are able to be operated separated from basic box element 10 and free of cables. Energy supply unit 20 includes an energy transmitting unit 50 assigned to light source unit 28, which is provided for line-free energy transmission, namely inductive energy transmission, for the energy supply of light source accumulator unit 66.

At energy terminal locations 45, 46 of energy supply unit 20 there is connected in each case a cable 48, 49 of energy supply unit 20, which is provided movably to support light sources 22, 32 of light source unit 18 relative to basic box element 10. In basic box element 10 a cable roll-up unit 76, 78 is provided for each cable 48, 49, of which each has a drive unit, namely a spring drive, using which cables 48, 49 are able to be automatically rolled up. Energy terminal locations 70, 72, 74 of energy supply unit 20 are connected to fixedly connected light sources, i.e. light sources 24, 26, 34 that are non-detachable from basic box element 10.

If charging unit 36 is connected to a network via a mains cable 80 of charging unit 36, hand tool accumulator units 62 and light source accumulator units 66, 68 are able to be charged via connecting unit 52, and light sources 22-34 are able to be operated using electrical energy from the network. If mains cable 80 is disconnected from the network, light sources 22-34 are supplied with electrical energy by hand tool accumulator units 62 and light source accumulator units 66, 68. Energy supply unit 20 has a current and voltage conversion unit, so that energy supply unit 20 is able to be connected to networks and/or energy stores, having direct current and alternating current, and having different voltages.

Light sources 30, 32, 34 are situated on an inner side of basic box element 10, i.e. on a side facing storage space 14, in three different side regions, and are used, in first place, for illuminating storage space 14 and its close surroundings, and as a matter of fact, light source 30 is situated directly next to accumulator unit storage space 53, and is used to illuminate it, and light source 34 is situated in the vicinity of a carrying handle, and is used, in first place, for illuminating the accumulator unit hand tool and a corresponding storage space, and light source 32 is situated directly next to a storage space for insertable tools 64, and is used for illuminating the storage space of insertable tools 64. In particular, light source 30, which is able to be operated disconnected from basic box element 10 and in a manner free of cable, and light source 32, which is movable relative to basic box element 10 using cable 49, are also able to be used to illuminate a region outside storage space 14.

Light source unit 18 also has accommodation regions 54-60 on outer sides of basic box element 10, which are provided for the accommodation of light sources 22-28. light sources 22-28 are used for illuminating a working space outside storage space 14. Accommodation regions 54-60 include recesses, light sources 24, 26 being completely countersunk in the recesses, and light sources 22, 28 are able to be countersunk in the recesses, so that outer surfaces of light sources 22-28 in the countersunk state close off flush, that is, in one plane, with the outer surfaces of basic box element 10. In this context, light source 26 is situated on an upper side, on which the carrying handle is also situated. Light source 24 is situated in a side region of the box, and light source 28 is situated in a corner region of basic box element 10, or rather, of shell-shaped element 13, and closes with three different side surfaces of shell-shaped element 13. It would basically also be conceivable that a light source would close with only two, or with more than three side surfaces of basic box element 10. Light source 22 includes a plate-shaped component, that is, a height 82 and a width 84 of light source 22 are each greater by a multiple than a thickness 86 of light source 22. Light source 22 is situated in the vicinity of a floor plate 88 of shell-shaped element 13, and covers floor plate 88 of shell-shaped element 13 for the most part.

What is claimed is:

1. A tool box, comprising:

a basic box element including at least one storage space adapted to accommodate at least a tool and a tool battery unit which is electrically and releasably connectable to the tool; and at least one light source unit at least partially integrated into and fixedly connected to the basic box element, wherein the at least one light source unit includes at least one energy supply unit adapted to supply energy to at least one light source of the at least one light source unit, said at least one energy supply unit includes a connection unit adapted to electrically and releasably connect the tool battery unit to the connection unit to supply energy from the tool battery unit to the at least one light source, wherein the connection unit is at least partially integrated into and fixedly connected to the basic box element in the at least one storage space, wherein the at least one light source unit further includes at least one accommodation region at an outer side of the basic box element adapted to fully accommodate the at least one light source configured for outside illumination of a working area, wherein the at least one light source unit includes a rectangular plate-shaped component that forms at least part of a side of the basic box element.

2. The tool box according to claim 1, wherein the tool box is arranged as a hand tool box.

3. The tool box according to claim 1, wherein the at least one energy supply unit includes at least one charging unit.

4. The tool box according to claim 1, wherein the at least one energy supply unit includes at least one energy terminal location adapted for detachable connection to at least one energy terminal location of the at least one light source of the at least one light source unit.

5. The tool box according to claim 1, wherein the at least one energy supply unit includes at least one energy terminal location for a cable adapted to movably support the at least one light source of the at least one light source unit relative to the basic box element.

6. The tool box according to claim 5, wherein the at least one energy supply unit includes at least one cable adapted to movably support the at least one light source of the at least one light source unit relative to the basic box element.

7. The tool box according to claim 1, wherein at the at least one energy supply unit includes at least one energy transmission unit adapted for line-free energy transmission.

8. The tool box according to claim 1, wherein the connection unit connects battery unit storage space of the basic box element to an additional part of the at least one light source unit by energy technology.

9. The tool box according to claim 1, wherein the at least one light source unit includes at least two light sources.

10. The tool box according to claim 1, wherein the at least one light source unit includes at least one light source having more than 10 W.

11. The tool box according to claim 1, wherein the accommodation region includes at least one recess.

12. The tool box according to claim 11, wherein the at least one light source unit is adapted to be countersunk in the recess, at least for a most part.

13. A system, comprising:

a tool box according to claim 1; and at least one of (a) at least one hand tool and (b) at least one hand tool battery unit.

14. The tool box according to claim 1, wherein the at least one light source unit includes two light source units that are situated in two different regions of the basic box element.

15. The tool box according to claim 1, wherein the at least one light source unit includes three light source units that are situated in three different regions of the basic box element.

16. The tool box according to claim 1, wherein the rectangular plate-shaped component has a height and a width that is greater by a multiple than a thickness of the plate-shaped component.

17. The tool box according to claim 1, wherein at least one light source of the at least one light source unit is situated on a same side as a carrying handle of the tool box.

18. The tool box according to claim 11, wherein the recess is adapted to accommodate the at least one light source unit such that an outer surface of the light source unit is substantially in one plane with an outer surface of the basic box element.

19. A tool box, comprising:

a basic box element including at least one storage space adapted to accommodate at least a tool and a tool battery unit; and at least one light source unit at least partially integrated into and fixedly connected to the basic box element, wherein the at least one light source unit includes at least one energy supply unit adapted to supply energy to at least one light source of the at least one light source unit, said at least one energy supply unit includes a connection unit adapted to electrically and releasably connect the tool battery unit to the connection unit, wherein the connection unit is at least partially integrated into and fixedly connected to the basic box element, wherein the at least one light source unit further includes at least one accommodation region at an outer side of the basic box element adapted to accommodate the at least one light source for outside illumination, wherein a recess is adapted to receive the at least one light source unit such that an outer surface of the light source unit is flush with an outer surface of the basic box element.

20. A tool box, comprising:

a basic box element including at least one storage space adapted to accommodate at least a tool and a tool battery unit; and at least one light source unit at least partially integrated into and fixedly connected to the basic box element, wherein the at least one light source unit includes at least one energy supply unit adapted to supply energy to at least one light source of the at least one light source unit, said at least one energy supply unit includes a connection unit adapted to electrically and releasably connect the tool battery unit to the connection unit, wherein the connection unit is at least partially integrated into and fixedly connected to the basic box element, wherein the at least one light source unit further includes at least one accommodation region at an outer side of the basic box element adapted to accommodate the at least one light source for outside illumination, wherein the at least one light source unit includes a rectangular plate-shaped component that forms at least a majority of a side of the basic box element.

* * * * *